United States Patent [19]

Pries

[11] 3,963,583

[45] June 15, 1976

[54] BATTERY OF HORIZONTAL COKE OVENS

[76] Inventor: Erich E. Pries, Agnesstrasse 53, 463 Bochum, Germany

[22] Filed: July 2, 1975

[21] Appl. No.: 485,208

Related U.S. Application Data

[63] Continuation of Ser. No. 279,039, Aug. 9, 1972, abandoned.

[52] U.S. Cl. ..... 202/263; 214/18 PH

[51] Int. Cl.[2] ..... C10B 5/00

[58] Field of Search ..... 202/250, 251, 262, 263; 201/40; 214/18 PH

[56] References Cited

UNITED STATES PATENTS

| | | | |
|---|---|---|---|
| 899,503 | 9/1908 | Bernhard | 202/262 |
| 976,930 | 11/1910 | Schniewind | 202/262 |
| 1,376,313 | 9/1921 | Becker | 202/262 |
| 1,785,750 | 12/1930 | Van Ackeren | 202/262 |
| 1,785,751 | 12/1930 | Van Ackeren | 214/18 PH |
| 3,697,381 | 10/1972 | Kemmetmueller | 202/262 |

FOREIGN PATENTS OR APPLICATIONS

| | | | |
|---|---|---|---|
| 10,485 | 1909 | United Kingdom | 202/262 |

*Primary Examiner*—Norman Yudkoff
*Assistant Examiner*—Hiram Bernstein
*Attorney, Agent, or Firm*—Brown, Murray, Flick & Peckham

[57] ABSTRACT

A battery of horizontal coke ovens having intermediate walls that divide the ovens into units each consisting of 10–20 oven chambers for the purpose of receiving coal from a charging car displaceable above each unit of oven chambers. The charging car includes a plurality of bins each having an outlet for alignment with one of a plurality of charging holes provided in the roof for each oven chamber. The charging car is transversed along a frame supported by vertical beams extending from the intermediate walls. A conveyor belt is employed to transport coal from a tower to the charging car.

7 Claims, 6 Drawing Figures

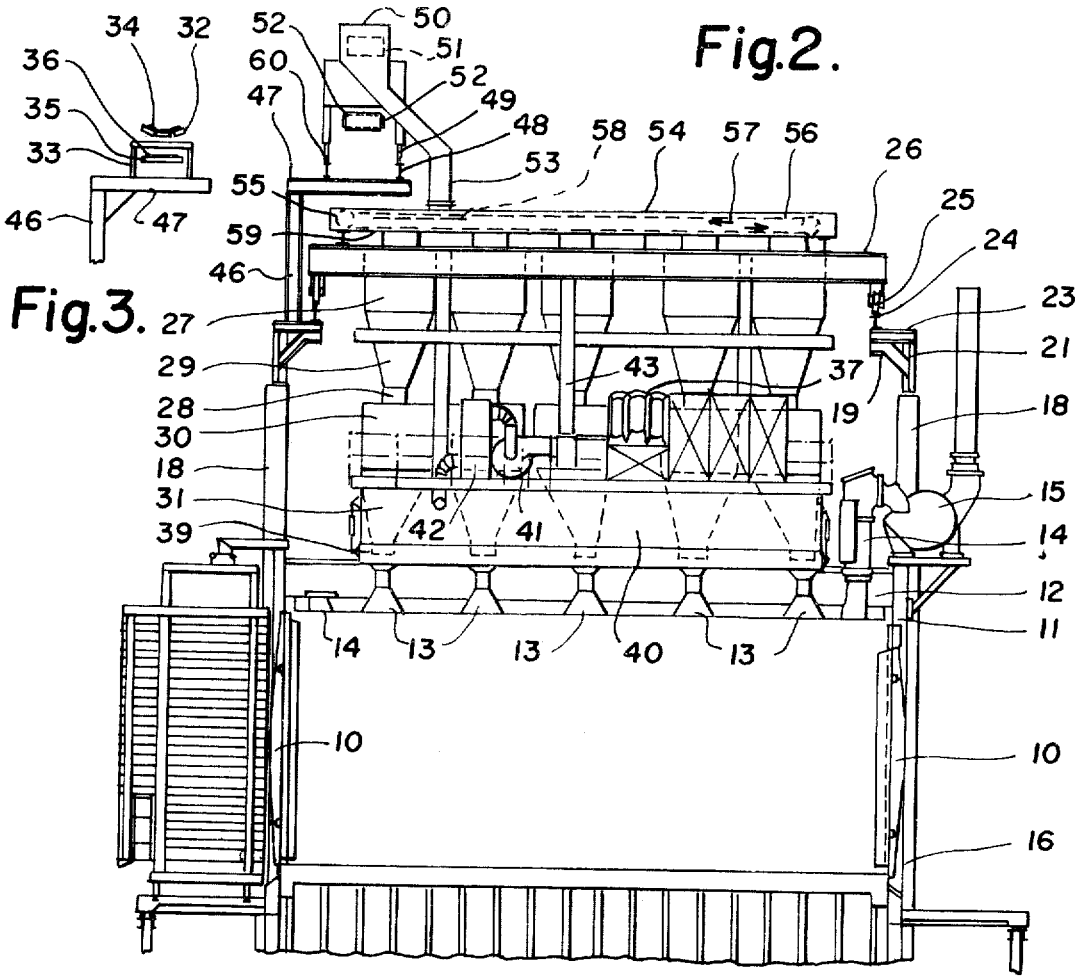
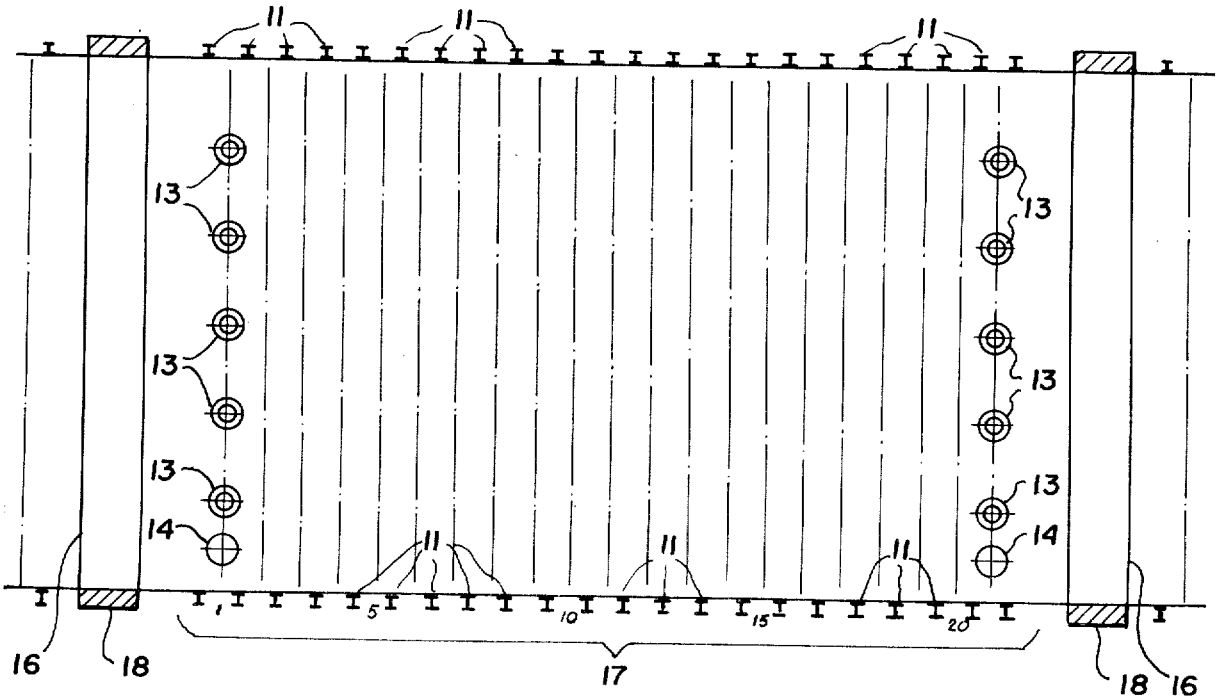
Fig.4.

Fig.5.
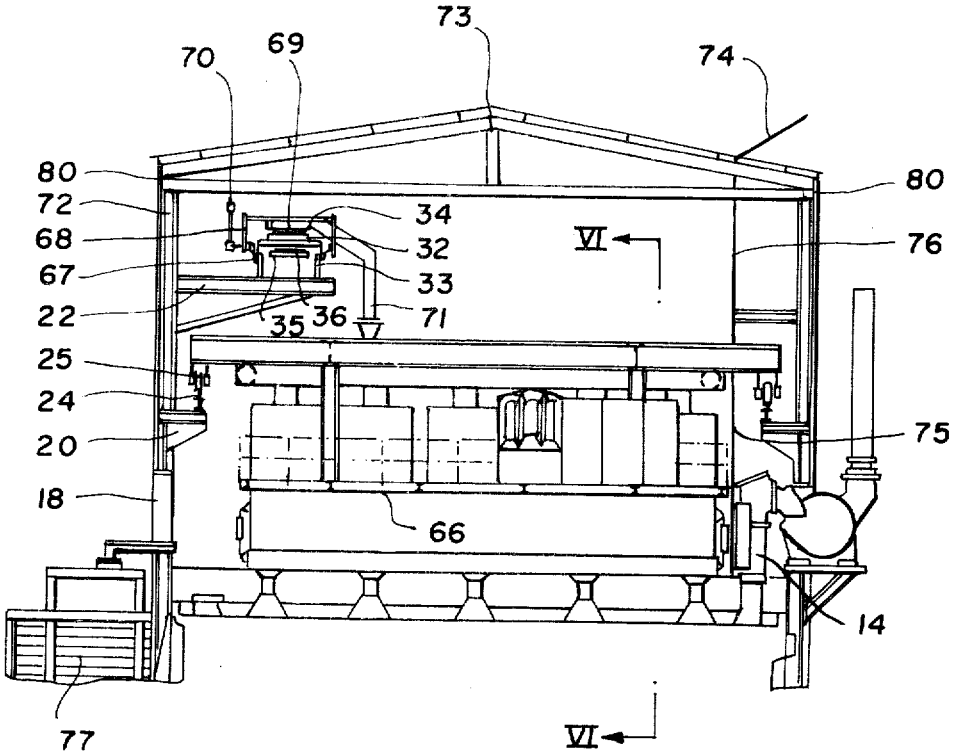
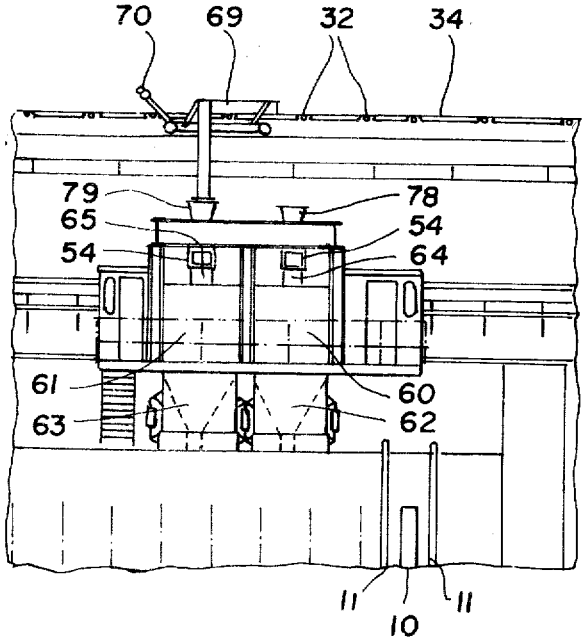
Fig.6.

BATTERY OF HORIZONTAL COKE OVENS

This is a continuation, of application Ser. No. 279,039, filed Aug. 9, 1972 and now abandoned.

BACKGROUND OF THE INVENTION

It is a conventional practice to charge horizontal coke ovens by means of a charging car having individual bins provided with outlets that correspond to the charging openings provided in the roof of the coke ovens. Rails were arranged on the oven roof for supporting the charging car during its traverse movement along the row of ovens. Such an arrangement is not suitable for the large volume present-day coke oven designs which include ever increasing dimensions to the oven chamber height and chamber length. These designs require a more rapid coke pushing sequence for the oven chambers that are increased in number. When charging these oven chambers, the load and weight of the charging car has greatly increased, and the car must operate at higher speeds.

An attempt was made in the United States during the early history of coke oven designs to relieve the supporting oven masonry of the charging car weight by placing a grid-like structure on anchoring stands which included a suspension rail-type structure. This design did not succeed in producing the desired result and was abandoned many years ago.

Studies have recently established that the masonry extending vertically in the heating walls is capable of supporting the weight of the charging car, even when the dimensions of the oven chambers are increased in size. However, the vibrations and shock which occur during operation of the charging car result in a gradual cracking of the upper oven masonry due to the large forces produced by the high capacity charging cars and large forces developed during the rapid acceleration and deceleration of the car for high speed operation. The charging car must operate at high speeds in order to accommodate the modern coke oven capacities and therefore there is a constant movement of the charging car upon the roof of the furnace. With the gradual cracking of the upper masonry, there occurs dangerous and undesirable gas losses along with their unintentional combustion. Moreover, as graphite is collected in these cracks and any loosened joints occurring in the masonry, there is produced separating forces in the oven roof that may destroy the entire upper oven masonry. Therefore, such leaks must be completely avoided under all conditions.

It is pointed out that the furnace masonry is not isolated from such vibrations when a support frame having rails for the charging car is placed on the oven roof even though the anchoring pillars supporting the oven masonry on both sides are made to bear the weight of the rails.

SUMMARY OF THE INVENTION

It is an object of the present invention to provide a support structure for a charging car arranged to operate at a spaced location above the roof of a coke oven in a manner that vibrations and forces occurring during the operation of the car are isolated from the oven.

It is a further object of the present invention to provide a charging car support structure which will not impede the operation of pushers for discharging coke from the oven chamber while at the same time providing a required load bearing capacity for supporting the weight of the charging car during its movement over a large area above the oven.

According to the present invention, a battery of horizontal coke ovens is divided into units consisting of 10–30 oven chambers. Each unit of oven chambers is provided with a charging car displaceable on a frame supported at both sides of the coke oven in the zone of the port ends thereof by vertical columns extending between adjacent oven units. Rails for the charging car are supported by brackets extending inward from the port ends and secured to vertical columns. A belt conveyor supported by the frame conveys a coal charge from a tower or the like to the charging car where a scraper discharges the coal from the conveyor belt into the charging car. In its preferred form, the charging car includes storage bins designed to contain sufficient coal to charge an oven chamber. The bins are provided with a plurality of outlets aligned with coal charging openings in the roof of the oven chamber. The present invention further provides an embodiment wherein two storage bins are provided whereby while the coal in one bin is being discharged into the oven chamber, the other bin is receiving a coal charge from the belt conveyor. The coal charge for an oven chamber is automatically controlled by a weighing bin located at a coal tower in a manner that the contents of the weighing bin are released to the conveying belt for transfer to the storage bin of the charging car when the storage bin is in condition for receiving a coal charge. The charging car may further include discharge bins for releasing a coal charge to a coke chamber and then receiving another coal charge from the storage bin.

The present invention further provides an improved charging car to overcome the problem of released gases during the charging of the ovens by providing on the charging car a hood to enclose the coal charging bins. The hood is associated with a suction apparatus and a flue. Each bin includes a rim at its lower end having asbestos or the like to act as a resilient means to engage the furnace roof in a gas-tight manner.

These features and advantages of the present invention will be more readily understood when the following description is read in light of the accompanying drawings, in which:

FIG. 2 is a sectional view taken along line II—II of FIG. 1;

FIG. 3 is a vertical sectional view taken along line III—III of FIG. 1;

FIG. 4 is a plan view taken along line IV—IV of FIG. 1;

FIG. 5 is a vertical sectional view of a second embodiment of the present invention; and FIG. 6 is a sectional view taken along line VI—VI of FIG. 5.

Figure 1:
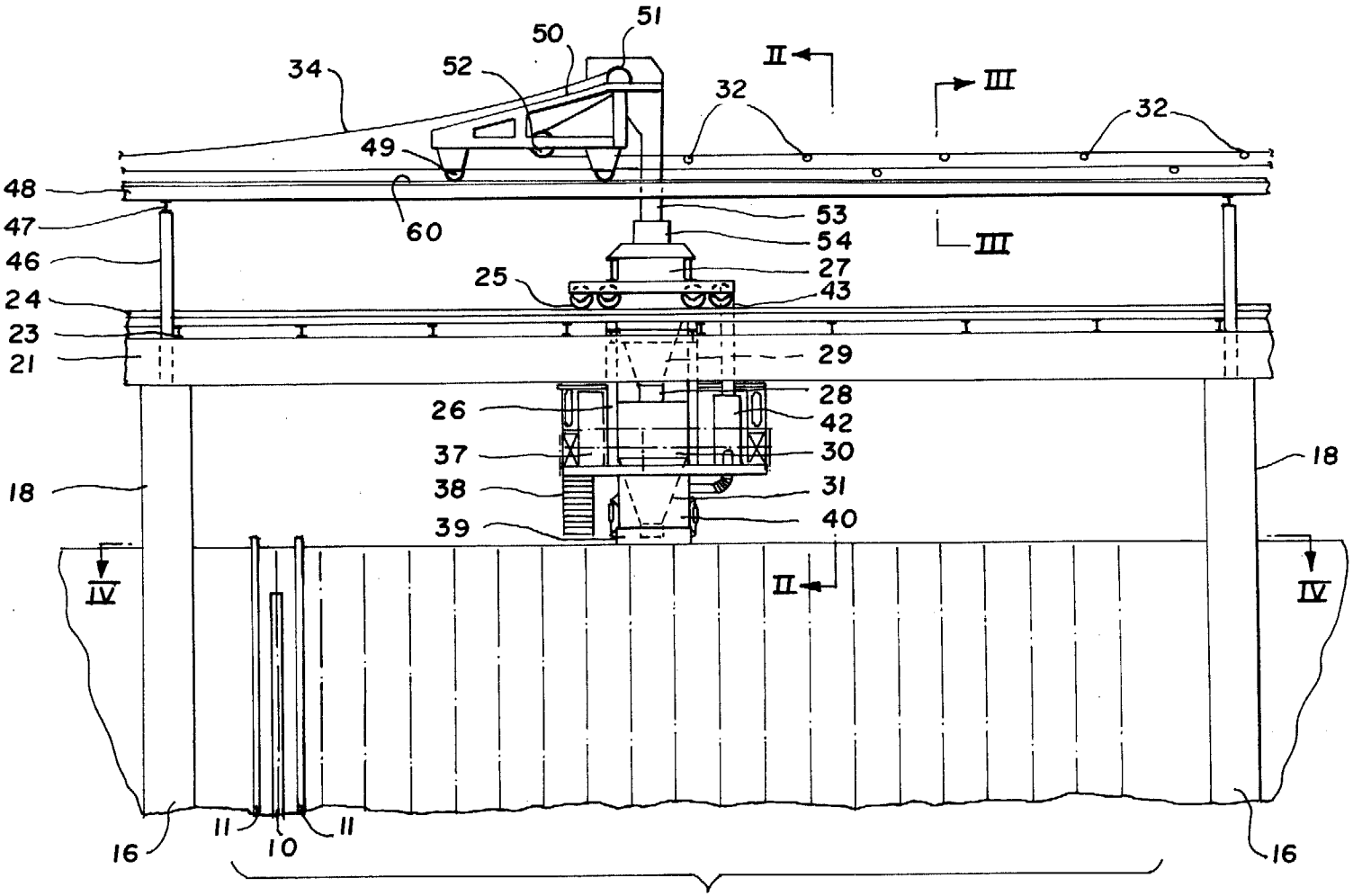
FIG. 1 is a partial side view of a battery of horizontal coke ovens having a frame for supporting a charging car according to the features of the present invention.

With reference now to FIGS. 1 and 2 of the drawings, doors 10 are provided for closing each of the oven chambers at their portal ends. Anchoring pillars 11 brace the masonry of the individual oven chambers. An oven roof 12 has for each chamber five charging holes 13 and a sixth hole communicating with a vertically-arranged pipe 14 connected to a main pipe 15 extending horizontally along the entire battery of oven chambers to remove gases from the chambers during charging.

FIG. 1 illustrates a series of oven chambers, twenty in number, to represent a group or unit of oven chambers identified collectively by reference numeral 17. The features of the present invention provide that between adjacent oven chamber units 17 is intermediate walls 16. The walls 16 are constructed with an increased width by reinforced concrete and have integral vertical supports 18 anchored to the oven foundation.

At the top of the supports 18 there is located a continuous frame along each side of the units of coke chambers. The frame consists of struts 19 secured to vertical plates 21 and a plurality of I-beams 23. The I-beams each extend in a longitudinal direction of the coke oven battery and carry rails 24 for supporting four wheels 25 at each side of a charging car 26.

The charging car has a plurality of upper storage hoppers 27 each connected to a charging bin 29 with lower closures 28. The closures 28 communicate with lower hoppers 30 from which the coal is released directly through five discharge bins 31 into a charging opening 13 in an individual manner. During the discharge of coal from the hoppers 30, it is intended that the coal will slide from the hoppers or additional devices can be provided for loosening the coal and preventing the packing of coal at the walls. Conveyor chutes or turntables, known in the art, may be employed to provide an exact adjustment to the coal flowing through the chutes.

As shown in FIGS. 2 and 3, at the side of the oven chambers opposite the gas collecting main pipe 15, pillars 46 extend vertically from the support 18. These pillars carry horizontal beams 47. The beams 47 support brackets 33 of an endless conveyor belt 34 carried by rollers 32 when transferring coal, and rollers 35 support the conveyor belt shown at 36 in its emptied condition.

The beams 47 bear rails 48 that support wheels 49 of a stripper carriage 50. Carriage 50 is formed as an integral part of the charging car 26 and movable therewith. As shown in FIGS. 1 and 2, the belt 34 passes into the carriage 50 where it engages a discharge roller 51 arranged forward and above a second roller 52 by which the belt is returned to its normal elevation for support by rollers 32. An inclined hopper 53 connects the carriage 50 to the charging car 26.

The coal discharged from the belt by the roller 51 passes through a hopper 53 and onto a casing 54 of a trough chain conveyor. Within the casing 54, there is provided an endless scraper chain 56 passing around rollers 55 in a direction indicated by the arrows 57 to uniformly distribute the coal along the casing 54. A table plate 58 is arranged within the casing 54 below the hopper 53. At the bottom of the casing 54 there is provided a plurality of openings 59 receiving coal from the scraper chain 56. Coal is conveyed by the belt 34 from a tower, not shown, to the carriage 50 where the coal is discharged by the roller 51 into the hopper 53 and onto the scraper chains 54 which distribute in a uniform manner. As the coal drops through the openings 59, it passes into the hoppers 27 of the charging car.

Since the lower hopper 30 is empty after charging of the oven chamber, coal is released from the upper hoppers 27 by opening the closure 28 to release coal into the hopper 30. A cabin 37 in the charging car has a ladder 38 extending downwardly toward the roof of the oven to provide access for an operator to control, among other things, the drive for the conveyor belt. A hood 39 is supported by the charging car in a manner so that it can be lowered onto the oven roof 12 to form an enclosure between the discharge bins 31 and the charging holes 13 provided in each oven chamber. The space 40 within the hood 39, is connected to a flue 43. The flue 43 is further connected to an exhaust blower 41 and a washer 42. The space within the hood 39 contains apparatus, not shown, for raising and lowering the covers for the furnace charging holes.

The second embodiment of the present invention illustrated in FIGS. 4 and 5 differs from that previously described with respect to FIGS. 1, 2 and 3 by the fact that coal charging car 66 has two coal charging bins arranged one behind the other in the direction of charging car travel. These coal charging bins each serve the same function to load coal into the furnace chambers. Filling pipes 64 deliver coal to hoppers 60 which have discharge bins 62. Filling pipes 65 deliver coal to hoppers 61 which have discharge bins 63. Above both series of filling pipes 64 and 65, there is arranged a trough chain conveyor employed to charge both hoppers 60 and 61 respectively. Each chain conveyor includes a casing 54 constructed and arranged in the same manner as previously described with respect to FIGS. 1 and 2. Hoppers 78 and 79 are each supported by the casings 54. The charging car 66 includes the wheels 25 supported on the rails 24 which are, in turn, carried by the brackets 20 carried by supports 18.

The supports 18 additionally bear the load of other supports 72 employed to carry a roof 73. Horizontal beams 22 are carried by the supports 72 at the coke side of the oven battery where there is arranged the conventional coke guide grating 77. The beams 22 each support a frame 33 having a roller 32 for supporting the belt 34 in its upper coal bearing position and support roller 35 for supporting the belt in its lower return position 36 to a coal tower. The frame 33 has bearing surfaces 67 for supporting a frame 68 onto which there is secured a scraper blade 69. A lever 70 displaces the scraper blade 69 toward the coal bearing surface of the belt 34. A chute 71 is rigidly carried by the frame 68 such that when the scraper is lowered, coal is displaced from the belt 34 and falls through the chute 71 and onto one of the trough chain conveyors 54. The support frame 68 and the chute 71 are moved into a position above the hoppers 60 or 61, whereby coal then passes into either the hopper 78 or the hopper 79.

The embodiment illustrated in FIGS. 5 and 6 is operated by displacing the charging car 66 to a position such that the hopper 61 and discharge bins 63 are releasing coal into the oven chamber while at the same time coal is loaded into hopper 60 through filling pipe 64 and vice versa. The weight of the charging car 66 shown in FIGS. 4 and 5 and the charging car 26 shown in FIGS. 1 and 2, while increased, can be readily accommodated by the support structure provided according to the present invention which is arranged in an independent manner from the unit of the oven chamber.

The roof 73 is designed with a flat sloping top. At the machine side of the oven, hinged flaps 74 are arranged end to end along the roof above the ascending pipes whereby a flap is opened at a time when the pipe 14 is located directly below the opening. The opening of the flaps 74 may, if necessary, take place automatically by cam surfaces carried by the charging car 66. Aprons 75 and 76 protect the space above the oven cover from gases and vapors which rise out of the open end in the pipe 14.

At the coke side of the oven, columns 72 are provided to support a panel 80 for enclosing the space above the oven cover. Air polluting material in the area above the oven chamber may be continually exhausted through a filtering system.

As described above, the charging cars in both illustrated embodiments are traversed between adjacent units of oven chambers on rails supported by walls between these chamber units.

In this way, the oven roof is relieved of the vibrations and forces produced when a car is supported and operated directly on a coke oven roof. Moreover, the operation of the coke oven is not disrupted during the charging of coal into the oven. Practically no limits are set for the operating speed of the charging car. Thus, even with large coke oven batteries, the individual chambers can be charged in a rapid sequence. The division of batteries of coke ovens into smaller units proves advantageous for overcoming the phenomena of expansion of the oven masonry in the longitudinal direction of the battery.

It will be noted that the charging car arrangement according to the present invention requires shuttle transfer to the coal tower or the other coal discharge place, but that the cars remain near the unit of oven chambers which are to be charged, so that the loading of the coal into the charging car and the next loading of an oven chamber can take place in an immediate and rapid sequence.

The number of oven chambers which are to be served by each charging car can be greatly increased through the use of the coal conveying belt arranged in a longitudinal direction of the coke ovens and carried on the support structure for the charging car.

Although the invention has been shown in connection with a certain specific embodiment, it will be readily apparent to those skilled in the art that various changes in form and arrangement of parts may be made to suit requirements without departing from the spirit and scope of the invention.

I claim as my invention:

1. A coal charging apparatus in combination with a battery of horizontal coke ovens formed by a plurality of coke oven chambers which include an oven roof having a plurality of charging holes for loading coal into each oven chamber, the combination comprising:

a plurality of intermediate walls each of which extends horizontally between two adjacent oven chambers in a separate and independent manner to the masonry for said adjacent oven chambers, said intermediate walls dividing said battery of horizontal coke ovens into a plurality of coke oven units each consisting of a plurality of coke oven chambers;

support beams integral with the horizontal ends of said intermediate walls and extending vertically therefrom, said support beams being mechanically isolated from said coke oven chambers by said intermediate walls;

vertically arranged anchoring pillars at the horizontal ends of said coke oven chambers for bracing the masonry forming said chambers, said support beams and said anchoring pillars projecting substantially equal distances in a horizontal direction from the masonry for the battery of coke ovens;

a horizontal frame carried by said support beams in a spaced relation above said battery of horizontal coke ovens;

a coal charging car carried by said frame for positioning into a coal charging relation with a coke oven chamber, and a plurality of hoppers carried by said transfer car for transferring coal through the charging holes of an oven chamber.

2. An apparatus according to claim 1 further comprising spaced apart parallel rails extending along said unit of oven chambers, and support beams for each of said rails on said frame in a manner that said charging car is displaceable along said rails between said support beams.

3. An apparatus according to claim 2 further comprising conveyor means extending in a direction along one side of said battery of coke ovens for transferring coal to said charging car, coal removal means for discharging coal from said conveyor means into said charging car, and means for supporting at least a portion of said conveyor means on said frame.

4. The combination according to claim 3 wherein a coal charging car is supported by said frame for each coke oven unit defining said plurality of coke oven units.

5. An apparatus according to claim 3 wherein said charging car further includes a second and independent plurality of hoppers carried by said charging car in a side by side relation with the first said plurality of hoppers for transferring coal through the charging holes of a coke oven chamber.

6. An apparatus according to claim 5 further comprising:

a hood supported by said charging car for forming an enclosure between said plurality of hoppers and charging holes, and exhaust means connected to said hood for removing gases discharged from said plurality of charging holes.

7. An apparatus according to claim 3 wherein said charging car further comprises storage means arranged above said hoppers for receiving coal from said conveyor, and means for delivering coal from said storage means to each of said plurality of hoppers.

* * * * *